US007766735B2

(12) United States Patent
Ciepliski et al.

(10) Patent No.: US 7,766,735 B2
(45) Date of Patent: Aug. 3, 2010

(54) EXTERNALLY BAFFLED RIDGE VENT

(75) Inventors: Dustin Ciepliski, Calgary (CA); Jeff Hansen, Cedar Hill, TX (US)

(73) Assignee: Air Vent, Inc., Dallas, TX (US)

( * ) Notice: Subject to any disclaimer, the term of this patent is extended or adjusted under 35 U.S.C. 154(b) by 0 days.

(21) Appl. No.: 11/238,315

(22) Filed: Sep. 29, 2005

(65) Prior Publication Data

US 2007/0072540 A1 Mar. 29, 2007

(51) Int. Cl.
*F24F 7/02* (2006.01)

(52) U.S. Cl. ..... 454/365

(58) Field of Classification Search ..... 454/365, 454/364

See application file for complete search history.

(56) References Cited

U.S. PATENT DOCUMENTS

| | | | |
|---|---|---|---|
| 1,028,725 | A | 6/1912 | Hodgson |
| 1,717,728 | A | 6/1929 | Moore |
| 2,049,863 | A | 8/1936 | Palmer |
| 2,214,183 | A | 9/1940 | Seymour |
| 2,799,214 | A | 7/1957 | Roose |
| 2,868,104 | A | 1/1959 | Holt et al. |
| 2,988,980 | A | 6/1961 | Tschudin |
| 3,185,070 | A | 5/1965 | Smith |
| 3,236,170 | A | 2/1966 | Meyer et al. |
| 3,241,474 | A | 3/1966 | Rousey et al. |
| 3,303,773 | A | 2/1967 | Smith et al. |
| 3,326,113 | A | 6/1967 | Smith et al. |
| 3,481,263 | A | 12/1969 | Belden |
| D216,837 | S | 3/1970 | Swallow |
| 3,625,134 | A | 12/1971 | Smith |
| 3,660,955 | A | 5/1972 | Simon |
| 3,949,657 | A | 4/1976 | Sells |
| 4,073,106 | A | 2/1978 | Malott |
| 4,090,435 | A | 5/1978 | Vallee |
| 4,252,590 | A | 2/1981 | Rasen et al. |
| 4,280,399 | A | 7/1981 | Cunning |
| 4,325,290 | A | 4/1982 | Wolfert |
| 4,342,807 | A | 8/1982 | Rasen et al. |

(Continued)

FOREIGN PATENT DOCUMENTS

| | | | |
|---|---|---|---|
| GB | 2186898 | A | 8/1987 |

OTHER PUBLICATIONS

"The Lomanco Balance", 1 sheet product literature (Aug. 2003).

(Continued)

*Primary Examiner*—Steven B McAllister
*Assistant Examiner*—Samantha A Miller
(74) *Attorney, Agent, or Firm*—Duane Morris LLP

(57) ABSTRACT

Ridge vents and methods of their use are provided. In one embodiment, a rollable ridge vent for covering an opening of a roof ridge includes: an elongated flexible member having a central panel portion, a pair of lateral edges and a pair of transverse ends; a pair of vents disposed proximate to and inward of the lateral edges; a plurality of support ribs for supporting the central panel portion above the roof; and a pair of baffles disposed laterally from the vent openings, each pair of baffles comprising a plurality of baffle sections depending from the bottom surface of the central panel portion and oriented at an oblique angle to a respective proximate lateral edge.

20 Claims, 4 Drawing Sheets

U.S. PATENT DOCUMENTS

| | | | |
|---|---|---|---|
| 4,554,862 | A | 11/1985 | Wolfert |
| 4,643,080 | A | 2/1987 | Trostle et al. |
| 4,676,147 | A | 6/1987 | Mankowski |
| 4,782,743 | A | 11/1988 | Quinnell |
| 4,817,506 | A | 4/1989 | Cashman |
| 4,843,953 | A | 7/1989 | Sells |
| 4,903,445 | A | 2/1990 | Mankowski |
| 4,924,761 | A | 5/1990 | MacLeod et al. |
| 4,957,037 | A | 9/1990 | Tubbesing et al. |
| 5,009,149 | A | 4/1991 | MacLeod et al. |
| 5,070,771 | A | 12/1991 | Mankowski |
| 5,094,041 | A | 3/1992 | Kasner et al. |
| 5,095,810 | A | 3/1992 | Robinson |
| 5,112,278 | A | 5/1992 | Roberts |
| 5,122,095 | A | 6/1992 | Wolfert |
| 5,149,301 | A | 9/1992 | Gates |
| 5,167,579 | A | 12/1992 | Rotter |
| 5,288,269 | A | 2/1994 | Hansen |
| 5,457,920 | A | 10/1995 | Waltz |
| 5,458,538 | A | 10/1995 | MacLeod et al. |
| 5,542,882 | A | 8/1996 | Sells |
| 5,673,521 | A | 10/1997 | Coulton et al. |
| 5,772,502 | A | 6/1998 | Smith |
| 5,797,222 | A | 8/1998 | Martin |
| 6,128,869 | A | 10/2000 | Brotherton et al. |
| 6,149,517 | A | 11/2000 | Hansen |
| 6,227,963 | B1 | 5/2001 | Headrick |
| 6,233,887 | B1 | 5/2001 | Smith |
| 6,260,315 | B1 | 7/2001 | Smith |
| 6,299,528 | B1 * | 10/2001 | Hansen ..... 454/365 |
| 6,302,785 | B1 | 10/2001 | McKinney et al. |
| 6,361,434 | B1 | 3/2002 | Brandon |
| D456,531 | S | 4/2002 | O'Hagin |
| 6,371,847 | B2 | 4/2002 | Headrick |
| 6,450,882 | B1 | 9/2002 | Morris et al. |
| 6,684,581 | B2 * | 2/2004 | Robinson et al. ..... 52/198 |
| 6,991,535 | B2 * | 1/2006 | Ciepliski et al. ..... 454/365 |
| 2001/0019941 | A1 | 9/2001 | Headrick |
| 2002/0100232 | A1 | 8/2002 | Robinson et al. |
| 2003/0046878 | A1 | 3/2003 | Zdeb et al. |
| 2004/0088928 | A1 | 5/2004 | Headrick, II et al. |
| 2004/0088932 | A1 | 5/2004 | Headrick |
| 2005/0054284 | A1 * | 3/2005 | Ciepliski et al. ..... 454/365 |

OTHER PUBLICATIONS

Ridge Vent performance, Tales from the Attic, Air Vent Inc. product literature, 2 pages (Aug. 2008).

Solar Group, Inc. Shingle-Over, product literature, 2 pages (Apr. 2003).

Lomanco® LOR-30 Shingle Over Ridge Vent, product literature, 2 pages (2004).

Lomanco® OmniRoll OR-4 OmniRidge—Shingle Over Ridge Vent and OR-20 OmniRoll—Roll-out Shingle Over Ridge Vent product literature, 1 page (undated).

* cited by examiner

101

EXTERNALLY BAFFLED RIDGE VENT

CROSS-REFERENCE TO RELATED APPLICATION(S)

This application is related to commonly assigned patents and applications: U.S. Pat. No. 6,881,144 to Dustin Ciepliski and Jeff Hansen issued Apr. 19, 2005; U.S. Design patent application Ser. No. 29/209,647 filed Jul. 19, 2004, also to Ciepliski and Hansen, now U.S. Design Pat. No. D511,847; U.S. Design patent application Ser. No. 29/210,091 filed Jul. 27, 2004, also to Ciepliski and Hansen, now U.S. Design Pat. No. D210,091; and U.S. patent application Ser. No. 10/970,302 to Ciepliski and Hansen entitled "Externally Baffled Ridge Vent and Methods of Manufacture and Use" filed Oct. 21, 2004, now U.S. Pat. No. 6,991,535, the entirety of which are hereby incorporated by reference herein.

FIELD OF THE INVENTION

The present invention is related generally to ridge vents for covering the opening of the roof ridge, and more particularly to rollable, baffle and ridge vent assemblies.

BACKGROUND OF THE INVENTION

In the winter, household activities, such as cooking, showering and doing the laundry, generate moisture that can damage the attic insulation and building materials of the roof. In the summer, attic temperatures can rise to over 150° F., which can cause premature aging and cracking of wood and roofing materials. These elevated temperatures can also increase cooling costs for the home owner. In the construction of rooves, therefore, it is often desirable to provide a ventilation opening at the roof ridge and cover it with a vent. Ridge vents are passive ventilation systems which provide openings through which air can convectively flow to and from under the roof structure to provide ventilation.

Ridge vents typically cover any elongated opening, such as one that is formed in a roof and that extends along the peak of the roof, with the opening typically being in the range of about 10-20 cm in width and running along a substantial portion of the roof peak. Typical ridge vents include "shingle-over roof ridge vents" and exposed roof vents. See for example U.S. Pat. Nos. 6,361,434; 6,233,887; 6,450,882; 6,260,315 and published U.S. Application Nos. 2002/0100232A1 and 2004/0088932A1, all of which are incorporated herein by reference.

Many ridge vents have been developed that are made of polymeric materials that are flexible along a longitudinal axis in order to permit the ridge vent to conform to the sloped sides of a roof to cover the ridge opening. These ridge vents typically include a plurality of vents and supporting structures that depend from a common panel and that serve both the functions of resisting entry of precipitation, insects, and foreign manner, while providing supportive structures that lift the panel away from the roof and provide crush resistance. It is further desirable that ridge vents have means to create a "Venturi effect" or air draft to draw hot air outwardly from the underlying attic.

Prior art roof ridge vents are known that can be rolled for compact packaging and transport to an installation site. However, to make these ridge vents rollable requires some sacrificing of thermal efficiency in drawing hot air from the underlying attic, or costly modifications to the baffle structure in order to allow the ridge vent to be rolled in a spiral form. See U.S. Pat. No. 6,233,887.

Accordingly, there remains a need for a ridge vent, and particularly a rollable roof ridge vent which can be made cost-effectively, and which efficiently assists convection of heat and moisture from beneath a roof.

SUMMARY OF THE INVENTION

Ridge vents and methods of their use are provided. In one embodiment, a rollable ridge vent for covering an opening of a roof ridge includes: an elongated flexible member having a central panel portion, a pair of lateral edges and a pair of transverse ends; a pair of vents disposed proximate to and inward of the lateral edges; a plurality of support ribs for supporting the central panel portion above the roof; and a pair of baffles disposed laterally from the vent openings, each pair of baffles comprising a plurality of baffle sections depending from the bottom surface of the central panel portion and oriented at an oblique angle to a respective proximate lateral edge.

The above and other features of the present invention will be better understood from the following detailed description of the preferred embodiments of the invention that is provided in connection with the accompanying drawings.

BRIEF DESCRIPTION OF THE DRAWINGS

The accompany drawings illustrate preferred embodiments of the invention as well as other information pertinent to the disclosure, in which.

DETAILED DESCRIPTION OF THE INVENTION

Figure 1:
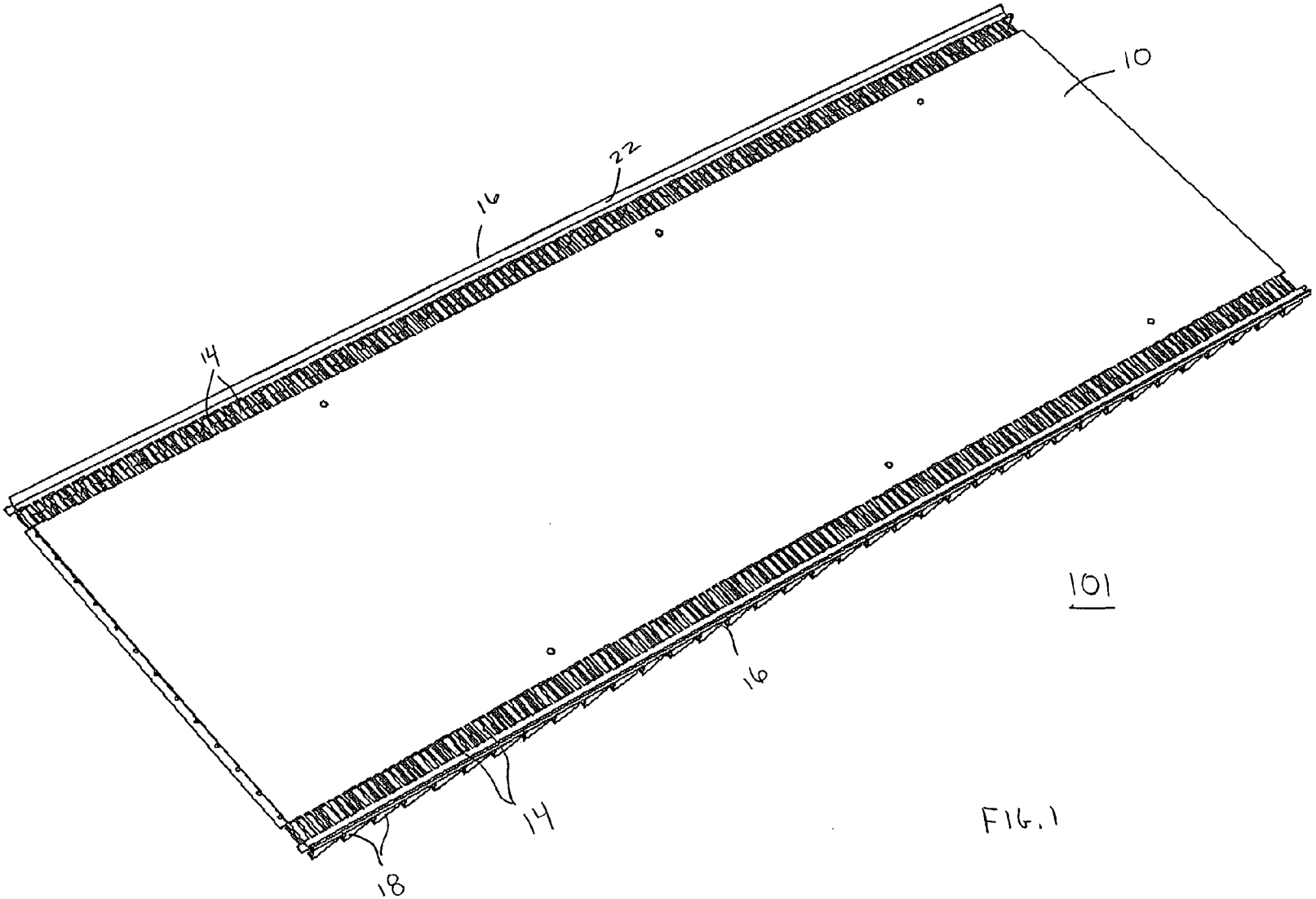
FIG. 1 is a top perspective view of a rollable ridge vent of the present invention.

This invention provides ridge vents which can be used in shingle-over roof vent applications, roll-out shingle over roof ridge vent applications, and in the applications where shingles are not employed over the vent. The roof vents of this invention can be designed for ridge and hip roof applications, they can have a low profile for a minimum accented ridge line. The vent opening or louver openings are preferably designed to keep out insects and weather infiltration, and the external baffles are desirably structured to deflect wind and rain and create negative air pressure ("Venturi effect"). The preferred external baffles are desirably molded into the roof vent in such a way that they can be readily rolled into a coil, laid out over an opening in a roof vent, and positioned in their final form easily, and without significant additional cost to the installer.

With respect to the drawings, and in particular FIGS. 1-4 thereof, a ridge vent 101 is provided for covering an opening of a roof ridge. The ridge vent 101 is preferably rollable into a spiral coil (not shown), but can be equally provided in a fixed or more rigid form. Examples of ridge vents rolled into spiral coils are shown in commonly assigned U.S. Pat. No. 6,881,144 and U.S. patent application Ser. No. 10/970,302 cross-referenced above and the entirety of which are hereby incorporated by reference as set forth above.

The ridge vent 101 includes an elongated flexible member having a generally planar central panel portion 10 defined between lateral edges 16, a pair of longitudinal side portions defining a pair of baffles and a pair of transverse ends. The central panel portion 10, which is preferably bi-axially flexible, includes a plurality of support ribs 12 for supporting the central panel portion 10 above a roof. The central panel portion 10 has a plurality of spaced air vents comprising a plurality of slotted vent openings 14 (best seen in FIG. 4) formed therethrough, and separated by slats 24, proximate to the lateral edges 16 of the central panel portion 10. Slats 24 form a part of, and are planar with the major surfaces of, central panel portion 10.

The baffles along the longitudinal sides of the ridge vent 101 preferably each include a plurality of angled baffle sections 18 formed integrally with and depending from the underside of the central panel portion 10 proximate to the lateral edges 16 and between the edges 16 and the air vents. Baffle sections 18 preferably depend generally perpendicularly (90°±30°) from the bottom major surface of central panel portion and are generally rectangular (meaning either rectangular or square) shaped, i.e., each baffle section 18 has a pair of opposite rectangular shaped major surfaces. The baffle sections 18 are spaced from one another at gaps and are preferably completely separate from one another, except that they downwardly depend from the common bottom surface of the central panel portion 10. Ribs 12 support the central panel portion 10 but are preferably not otherwise connected to baffle sections 18.

The major surfaces of adjacent baffle sections 18 are preferably parallel to one another. Each baffle section 18 is oriented at an angle "A" (FIG. 4) of between about 3-30°, and preferably about 8-15°, to its respective lateral edge 16 of the central panel portion 10, and more preferably about 10°. Adjacent baffles sections 18 are preferably offset from one another a distance "B" (FIG. 4) between about 0.030 to 0.125". When compared to aligned baffle sections that are not oriented at an angle, it is believed that the angled baffle sections allow for greater ease of rolling and help to prevent buckling when the ridge vent is rolled.

Figure 4:
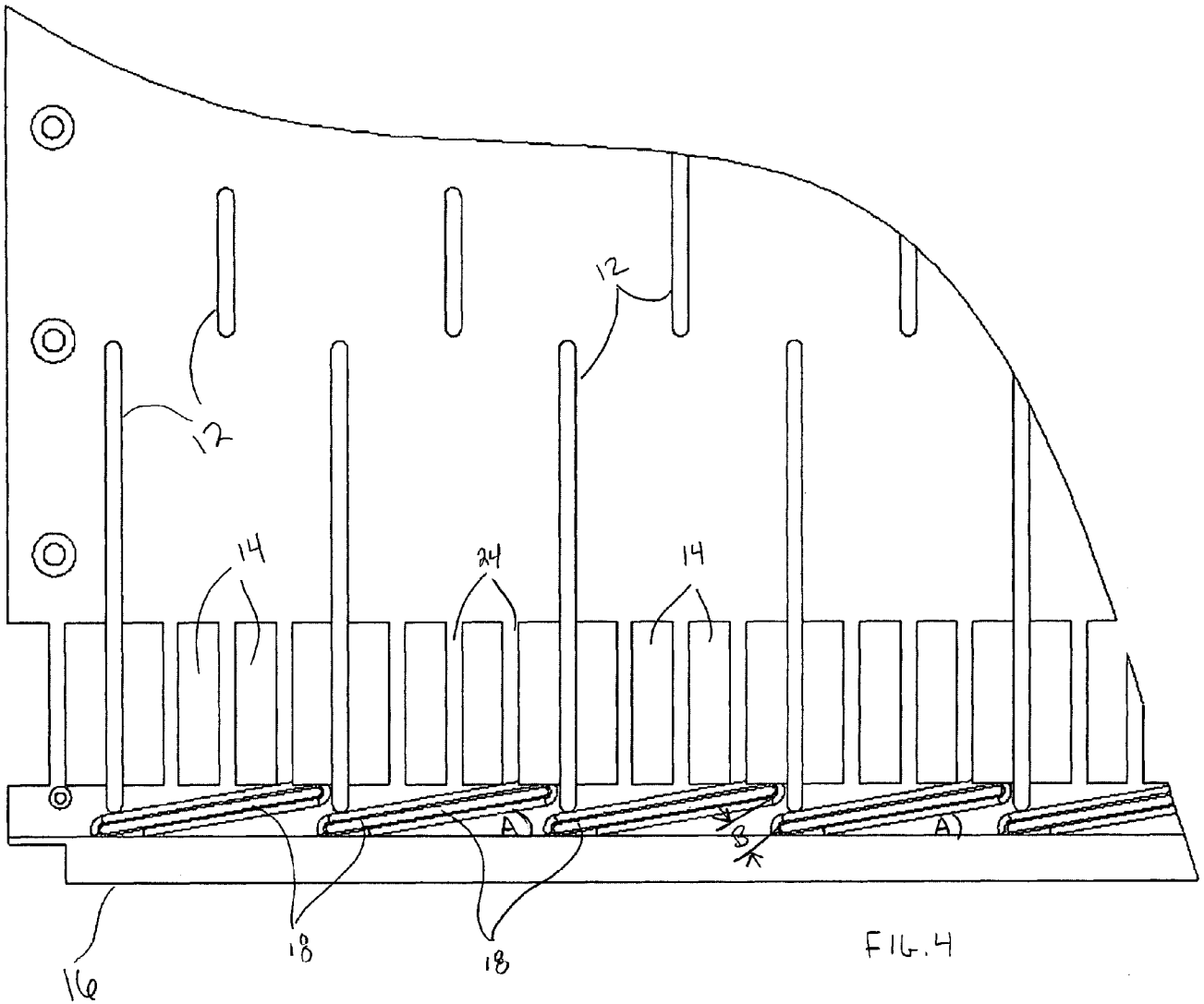
FIG. 4 is a bottom, enlarged view of a portion of the ridge vent of FIG. 1.

As best seen in FIG. 4, a support rib 12 is disposed proximate to the gap formed between adjacent angled baffle sections 18. These support ribs 12 extend beyond the air vents and help to prevent bugs, debris, water and other undesirable materials from entering through the longitudinal portions of the ridge vent 101.

The ridge vent 101 embodiment is preferably constructed from a polymer material, such as polypropylene, polyvinylchloride, or polyethylene, and more preferably from high impact copolymer polypropylene. The ridge vent 101 is laid over or unrolled over an opening in a roof ridge and is supported by ribs 12. The baffle sections 18 are seated generally perpendicular to (±30°) or upright in relation to the roof when the ridge vent is installed.

Dimensions of certain features of an exemplary embodiment of a rollable ridge vent 101 are now provided. Ribs 12 are preferably about 1/16" in thickness and about 1-4" in length. The distance between lateral edges is about 14". The baffle sections 14 are preferably about 1/16" in thickness and taper about 1° from the bottom major-surface of panel 10 to their bottom edges. The central panel 10 is about 0.07" in thickness. The height of the ridge vent defined from the bottom of the support ribs 12 to the top major surface of the central panel 10 is about 0.65". Each air vent 14 is about 0.7" long and about 0.18" wide, with a separation between vents (equal to the width of slats 24) of about 0.07".

The external baffle sections 14 are most desirably integrally formed with the ridge vent 101, are of solid (i.e., non-hollow) construction and form the longitudinal side portions of the ridge vent 101. They are designed to deflect wind and rain and create negative air pressure, or a Venturi effect to draw hot air outwardly from within the underlying attic. In the preferred embodiment 101 of the present invention, the baffle is preferably manufactured with the vent in a one piece construction. Because the baffles 18 are preferably not coupled to each other or to support ribs, other than indirectly in that they may depend from a common surface (i.e., the bottom surface of the central panel 10), the baffles can easily splay at gaps formed therebetween when the ridge vent 101 is rolled, thereby permitting the rollable ridge vent 101 to be rolled much more easily. The design also is compatible with cost-efficient manufacturing methods, such as index injection molding described in U.S. Pat. No. 6,881,144 referenced above, but other processes may also be used such as extrusion or compression molding, for example.

Figure 2:
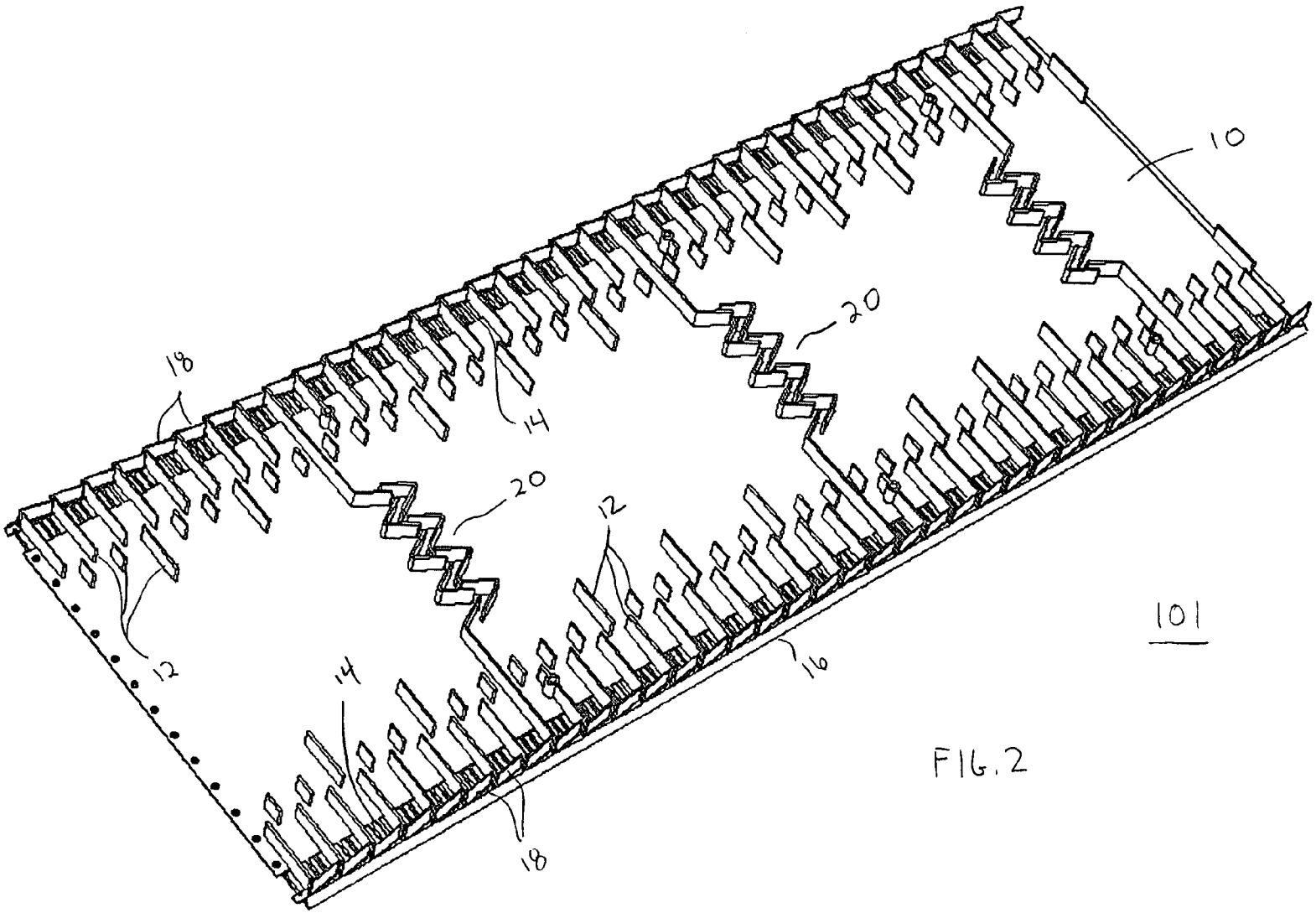
FIG. 2 is a bottom perspective view of the ridge vent of FIG. 1.
Figure 3:
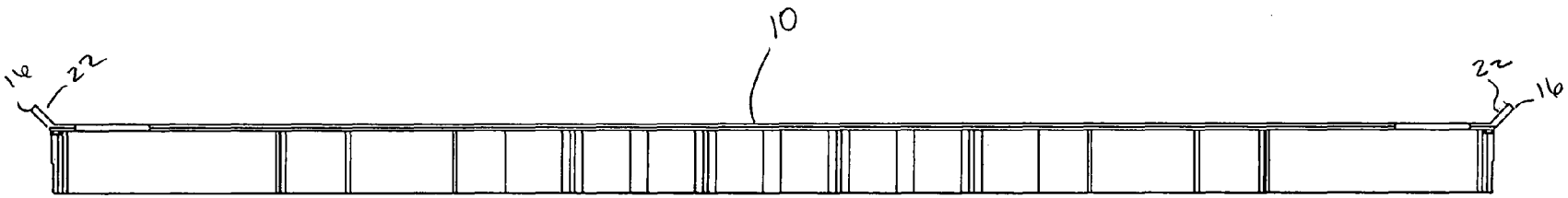
FIG. 3 is a front plan view of the ridge vent of FIG. 1.

With specific respect to the details of FIG. 2, the preferred ridge vent 101 further includes an internal gusset 20 for providing strength to and support for the central regions of the central panel portion 10. A plurality of internal gussets 20 are desirably molded or manufactured at the same time as the remaining portions of the ridge vent 101, and can contain the same polymer composition, a different or more rigid polymer composition, or a metallic insert for example.

The central panel portion 10 preferably includes upwardly angled lip portions 22 (best seen in FIG. 3) having a length of about ¼" and terminating at lateral edges 16 in further support of the desired air flow and venting effect. The lip portions 22 help to deflect air over the vent, preventing shingle blow up.

The ridge vents 101 are relatively easy to install in shingle over ridge vent or standard applications. In the preferred embodiment, the ridge vent 101 is unrolled and disposed over an opening of a roof ridge. The baffles 18 un-splay from their splayed orientation in the rolled vent to the orientation shown in FIGS. 1-4. In the shingle-over ridge vent installation methods, a plurality of shingles can be disposed over a portion of the ridge vent and both the ridge vent and the shingles can be simultaneously nailed to a roof substrate, such as plywood, studs, tongue and groove planks, or the like, to secure both the roof vent and shingles in place. An example of such an installation is shown in U.S. Pat. No. 6,881,144 referenced above. In that installation, the shingles are layered over the fasteners of the adjacent shingle, such as to minimize exposure to water leakage. The shingles are preferably layered so as to leave the vent openings 14 open. They should also not interfere with the Venturi action caused by the baffles 18. The ridge vent can further include a foam insert (not shown), which can seal the end of the vent prior to completion of the installation.

In one embodiment, an internal filter is coupled to the rollable ridge vent. An exemplary filter may be made of an untreated, unwoven fiberglass mesh. The filter may be attached to the vent by a heat staking process by which the support ribs 12 are melted into the filter material along the full length of the product. An exemplary filter is described in, for example, U.S. Pat. No. 6,149,517 to Hansen, the entirety of which is hereby incorporated by reference herein. The filter, of fiberglass mesh construction or the like, is provided beneath the central panel portion 10, for filtering out insects, snow, rain, debris, etc., while allowing sufficient air flow therethrough to accomplish the purposes of the rollable ridge vent.

From the foregoing, it can be realized that this invention provides improved roof vents, methods of installation, and methods of manufacture. The roof vents of this invention have adjustable baffles, which can splay for easier rolling, but which are oriented in a vertical direction for providing negative pressure when installed. Although various embodiments have been illustrated, this is for the purpose of describing, but not limiting the invention. Various modifications which will become apparent to one skilled in the art, are within the scope of this invention described in the attached claims.

What is claimed is:

1. A rollable ridge vent for covering an opening of a roof ridge, comprising:

an elongated flexible member having a central panel defined between a pair of lateral edges and a pair of transverse ends, said central panel having top and bottom major surfaces;

said central panel including a pair of vents forming openings through the top major surface of the central panel and disposed proximate to and inward of the lateral edges of said central panel;

a plurality of support ribs for supporting the central panel above the roof; and a pair of baffles disposed laterally from the vent openings, each baffle being proximate to a respective one of said lateral edges, each baffle comprising a plurality of spaced parallel baffle section walls depending from the bottom major surface of the central panel aligned in a row along the length of said central panel, each baffle section wall having first and second lateral edges and being oriented at an oblique angle to a respective proximate lateral edge of the central panel, the oblique angle orientation of each baffle section wall locating the first lateral edge of the wall more proximate to a respective vent than said second lateral edge of the wall, each pair of adjacent baffle section walls having a gap formed between the first lateral edge of a first one of said adjacent baffle section walls and the second lateral edge of a second one of said adjacent baffle section walls, wherein at least some of the support ribs extend laterally beyond the first lateral edge of the first one of the adjacent baffle section walls towards the second lateral edge of the second one of the adjacent baffle section walls to at least partially block said gaps therebetween to provide protection from infiltration of materials to an interior of said rollable ridge vent through the gaps.

2. The ridge vent of claim 1, where the baffle sections splay with respect to each other at gaps formed therebetween when the ridge vent is rolled.

3. The ridge vent of claim 1, wherein the oblique angle is between about 8-15°.

4. The ridge vent of claim 1, wherein the top major surface is generally planar when unrolled.

5. The ridge vent of claim 1, wherein the vents each comprise a plurality of spaced vent openings formed through the central panel.

6. The rollable ridge vent of claim 1, wherein the central panel is bi-axially flexible.

7. The rollable ridge vent of claim 1, wherein the pair of vents comprises a pair of slotted vent openings formed through the central panel and inward of the lateral edges.

8. The rollable ridge vent of claim 1, wherein the central panel is further supported by an internal, integral gusset.

9. The rollable ridge vent of claim 1, wherein the ridge vent further comprises a filter coupled thereto.

10. The ridge vent of claim 1, wherein the pair of baffles is disposed underneath the central panel.

11. The ridge vent of claim 1, wherein the first lateral edge of the first one of the adjacent baffle section walls and second lateral edge of the second one of the adjacent baffle section walls are substantially aligned along a line orthogonal to the respective proximate lateral edge of the central panel.

12. The ridge vent of claim 1, wherein the gap between the first and second lateral edges of the adjacent baffle section walls is 0.125" or less.

13. The ridge vent of claim 1, wherein each baffle section consists of a single baffle section wall depending from the bottom major surface of the central panel.

14. The ridge vent of claim 1, wherein the support ribs that at least partially block the gaps each includes a portion aligned generally perpendicular to a respective proximate lateral edge of the central panel, said portions at least partially blocking the gaps.

15. A rollable ridge vent for covering an opening of a roof ridge, comprising:

an elongated bi-axially flexible member having a central panel defining a pair of continuous lateral edges and a pair of transverse ends, the central panel having top and bottom major surfaces;

the central panel including a pair of vents disposed proximate to the lateral edges, each vent comprising a plurality of vent openings formed through the top major surface of the central panel and separated by slats formed by the central panel;

a plurality of support ribs for supporting the central panel above the roof; and a pair of baffles disposed laterally from the vent openings, each baffle being proximate to a respective one of said pair of continuous lateral edges, each baffle comprising a row of aligned parallel baffle sections depending generally perpendicularly from the bottom major surface of the central panel, each baffle section formed integrally only with the bottom surface of the central panel and comprising a single generally rectangular shaped baffle face defined between a first lateral edge of the baffle face and a second lateral edge of the baffle face, the baffle face being oriented at an oblique angle to a respective proximate lateral edge, the oblique angle orientation of each baffle face orienting the first lateral edge more proximate to a respective vent than the second lateral edge, each pair of adjacent baffle sections having a gap formed between the first lateral edge of the face of a first one of a pair of adjacent baffle sections and the second lateral edge of the face of a second one of the adjacent baffle sections, wherein at least some of the support ribs extend laterally generally perpendicular to the lateral edges of the central panel beyond the first lateral edge of the face of the first one of the adjacent baffle sections towards the face of the second one the adjacent baffle sections to at least partially block said gaps to provide protection from infiltration of materials to an interior of said rollable ridge vent through the gaps.

16. The rollable ridge vent of claim 15, wherein the baffle sections are disposed between the vent openings and the lateral edges.

17. The ridge vent of claim 15, wherein the pair of baffles is disposed underneath the central panel.

18. A rollable ridge vent for covering an opening of a roof ridge, comprising:

an elongated bi-axially flexible member having a central panel defined between a pair of continuous lateral edges and a pair of transverse ends, the central panel having top and bottom major surfaces;

the central panel including a pair of vents disposed proximate to the lateral edges, each vent comprising a plurality of slotted vent openings formed through the top major surface of the central panel;

a plurality of support ribs for supporting the central panel above the roof; and a pair of baffles disposed laterally from the vent openings, each baffle being proximate to a respective one of said pair of continuous lateral edges, each baffle comprising a row of aligned parallel baffle sections depending generally perpendicularly from the bottom major surface of the central panel, each baffle section formed integrally only with the bottom major surface of the central panel and comprising a single generally rectangular shaped baffle face oriented at an oblique angle between about 8-15° to a respective proximate lateral edge, each pair of adjacent baffle sections having a gap formed therebetween, wherein each baffle face is defined between first and second lateral edges, the first lateral edge being located more proximate to a respective vent than the second lateral edge, wherein at least some of the support ribs extend laterally beyond the vents to the gaps to at least partially block said gaps to provide protection from infiltration of materials to an interior of said ridge vent, individual ones of the support ribs extending beyond the first lateral edge of the face of a first baffle section from a pair of adjacent baffle sections towards a respective proximate lateral edge of the central panel.

19. The ridge vent of claim 18, wherein the baffle sections are disposed between the vent openings and the lateral edges.

20. The ridge vent of claim 18, wherein the pair of baffles is disposed underneath the central panel.

* * * * *